US007073678B1

(12) United States Patent
Dibdin et al.

(10) Patent No.: US 7,073,678 B1
(45) Date of Patent: Jul. 11, 2006

(54) TRAVEL BEVERAGE CONTAINER

(75) Inventors: Steven Dibdin, Brooklyn, NY (US); Clay Burns, New York, NY (US); Juan Escobar, New York, NY (US)

(73) Assignee: Helen of Troy Limited, Bridgetown (BB)

( * ) Notice: Subject to any disclaimer, the term of this patent is extended or adjusted under 35 U.S.C. 154(b) by 64 days.

(21) Appl. No.: 10/633,799

(22) Filed: Aug. 4, 2003

(51) Int. Cl.
*B65D 51/18* (2006.01)

(52) U.S. Cl. ..... 220/254.1; 220/714; 222/548

(58) Field of Classification Search ..... 220/254.1, 220/714, 715, 719, 724–728, 717; 222/153.12, 222/548, 545, 546
See application file for complete search history.

(56) References Cited

U.S. PATENT DOCUMENTS

| | | | | | |
|---|---|---|---|---|---|
| 3,246,807 | A | | 4/1966 | Micallef | |
| 3,727,808 | A | * | 4/1973 | Hanchett | 327/459 |
| 3,739,938 | A | * | 6/1973 | Paz | 220/715 |
| 3,877,614 | A | | 4/1975 | Murphy | |
| 3,964,631 | A | * | 6/1976 | Albert | 220/715 |
| 3,972,443 | A | * | 8/1976 | Albert | 220/715 |
| 4,094,433 | A | * | 6/1978 | Numbers | 220/715 |
| 4,099,642 | A | * | 7/1978 | Nergard | 220/715 |
| 4,133,446 | A | * | 1/1979 | Albert | 220/715 |
| 4,143,794 | A | | 3/1979 | Stratford et al. | |
| 4,318,500 | A | | 3/1982 | Melikian | |
| 4,778,087 | A | | 10/1988 | Desai | |
| 5,037,015 | A | * | 8/1991 | Collins | 222/472 |
| 5,312,019 | A | | 5/1994 | Tsao | |
| 5,330,081 | A | | 7/1994 | Davenport | |
| D375,655 | S | * | 11/1996 | King | D7/511 |
| 5,873,493 | A | | 2/1999 | Robinson | |
| 5,875,941 | A | * | 3/1999 | Hsu | 222/475.1 |
| 5,992,702 | A | | 11/1999 | Shapiro | |
| 6,098,834 | A | * | 8/2000 | Hatsumoto et al. | 220/715 |
| 6,209,757 | B1 | | 4/2001 | Dumont | |
| 6,244,470 | B1 | | 6/2001 | Harley-Wilmot | |
| 6,357,630 | B1 | | 3/2002 | Sperna Weiland | |
| 6,659,302 | B1 | * | 12/2003 | Lin | 220/254.8 |
| 6,702,138 | B1 | * | 3/2004 | Bielecki et al. | 220/254.9 |
| 6,935,536 | B1 | * | 8/2005 | Tardif | 222/153.14 |
| 2002/0033398 | A1 | | 3/2002 | Freeman et al. | |

* cited by examiner

*Primary Examiner*—Lien M. Ngo
(74) *Attorney, Agent, or Firm*—Seyfarth Shaw LLP

(57) ABSTRACT

A beverage container has a thermally insulated base defining a reservoir and a cover assembly removably mountable on the base for closing the reservoir. The cover assembly includes a cap defining a recess open to ambient and defines a baffled passage between the recess and the reservoir closeable by a valve assembly including a toggle mechanism actuatable by a push button disposed centrally of the cap and spaced from the recess, for alternately latching the valve in closed and open conditions relative to the passage. The valve assembly includes a gasketed movable valve member engageable with a rigid sharp edge on a valve seat in the closed condition so that the gasket yieldably deforms around the sharp edge to provide a fluid-tight seal.

8 Claims, 9 Drawing Sheets

2/9

107
108
106
100
104
105
101
102
103
96
90
95
94
93
92
91
114
112
115
113
117
123
116
111
110
124
84
87
86
75
85
80
83
81
33
36
37
30
38
39
25
21
29
60
71
66
61
72
70
68
62
62
46
59
57
58
56
47
54
55
41
43
42
44
48

TRAVEL BEVERAGE CONTAINER

BACKGROUND

This application relates to insulated containers provided with removable covers and, more specifically, to such containers for containing beverages.

In recent years, lidded beverage containers, commonly referred to as "travel cups" or "travel mugs", have become quite popular for use in vehicles or in other applications where the user is in motion. These containers are typically thermally insulated to maintain the temperature of hot or cold beverages, and may be provided with removable covers or lids, which are designed to permit drinking from the vessel while, at the same time, inhibiting accidental spillage of the type which might result from the sloshing of the contents, as during motion of an automotive vehicle or the like.

A number of these travel containers are provided with some type of valve mechanism which can be closed to prevent removal of contents through the lid. Some of these containers have automatic valve mechanisms designed to actuate, such as when the container is tipped over or inverted, to prevent the accidental flow of contents therefrom. Others have manually-operated valve mechanisms which may be opened to permit the user to drink beverage from the container and may be closed when not in use. One such latter device has a cover assembly with a large bowl-shaped recess at the upper end, provided at the center thereof with a large opening which receives a push button for actuation of a valve. The valve is of the toggle type, so that alternate pushes of the push button respectively latch the valve in open and closed conditions. A disadvantage of this arrangement is that, when the valve is open, beverage flows over the push button so that the user must operate a wet push button to close the valve.

A difficulty with many valved cover assemblies is leakage when the valve is in the closed condition. Another difficulty with many of these prior travel containers is that contents can flow very rapidly from a discharge opening when in use, which may cause accidental spillage, particularly when the user is drinking from the vessel in a moving vehicle subject to unexpected jarring and bouncing. This could be dangerous, particularly if the beverage is very hot.

SUMMARY

There is disclosed in this application a travel container for beverages which avoids the disadvantages of prior containers, while affording additional structural and operating advantages.

An aspect of the disclosed container is that it provides a manually-actuated valve assembly arranged so that, in use, the manual actuation device does not come in contact with dispensed beverage.

Another aspect is the provision of a valved container which provides an effective fluid-tight seal in the closed condition.

A still further aspect is the provision of a container which provides a baffled discharge passage to inhibit rapid flow of beverage therethrough.

In particular, there is disclosed a beverage container comprising: a base defining a beverage-containing reservoir, and a cover assembly removably mountable on the base for closing the reservoir, the cover assembly including a cap defining a recess open to ambient, the cap having an aperture therethrough spaced from the recess, the cover assembly defining a drain/drink passage communicating with the recess, the cover assembly including a valve assembly movable between an open condition providing communication between the reservoir and the passage and a closed condition sealing the passage from the reservoir, the valve assembly including a manually operated actuator mechanism accessible through the aperture.

There is also disclosed a beverage container comprising: a base defining a beverage-containing reservoir, a cover assembly removably mountable on the base for closing the reservoir, the cover assembly defining a passage for providing communication between the reservoir and ambient, and a valve assembly carried by the cover assembly and having a valve seat and a valve member movable between a closed condition closing the passage and an open condition opening the passage, one of the valve seat and the valve member including a relatively soft flexible and resilient gasket, another of the valve seat and the valve member including a rigid sharp edge which engages the gasket in the closed condition of the valve member so that the gasket yieldably deforms around the sharp edge for providing a fluid-tight seal.

There is also disclosed a beverage container comprising: a base defining a beverage-containing reservoir, and a cover assembly removably mountable on the base for closing the reservoir, the cover assembly defining a passage therethrough for providing communication between the reservoir and ambient, the cover assembly including baffle structure disposed in the passage for inhibiting rapid flow of beverage from the reservoir through the passage.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
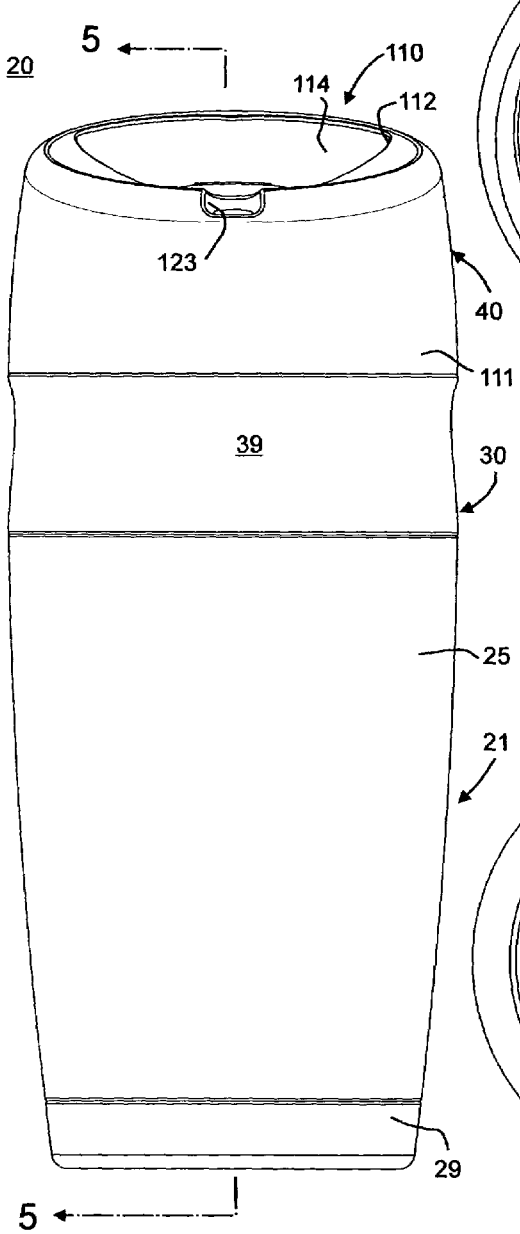
FIG. 1 is a front elevational view of an embodiment of beverage container.
Figure 2:
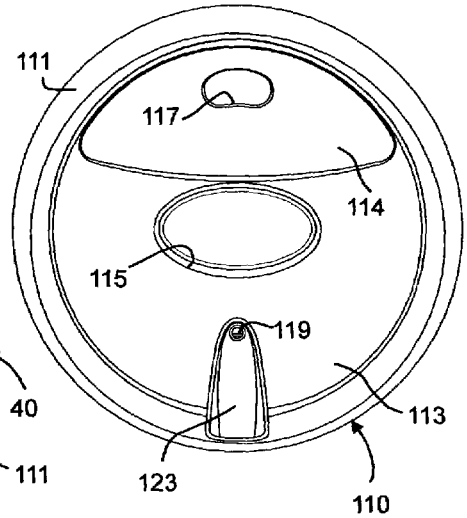
FIG. 2 is an enlarged top plan view of the beverage container of FIG. 1.
Figure 3:
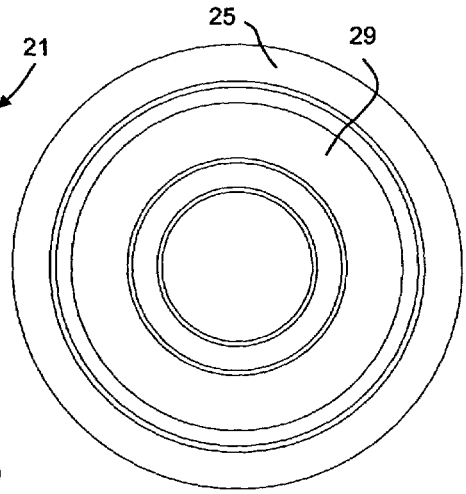
FIG. 3 is an enlarged bottom plan view of the beverage container of FIG. 1.

Referring to FIGS. 1–5, there is illustrated a beverage container, generally designated by the numeral 20, having an insulated base 21 including a generally cup-shaped inner wall 22 (FIG. 5) terminating at an upper rim 23 provided with a radially outwardly projecting circumferential rib 24. The base 21 also includes a generally cup-shaped outer wall 25 provided adjacent to its upper end with a radially inwardly projecting annular shoulder 26, integral at its inner end with an upstanding substantially cylindrical flange 27, which is fixedly secured to the outer surface of the inner wall 22, as by welding. The inner and outer walls 22 and 25 may be formed of metal, such as stainless steel, and are spaced apart for cooperation to define therebetween a thermally insulating vacuum space 28. Secured to the bottom of the outer wall 25 by suitable means is a base pedestal 29.

Figure 5:
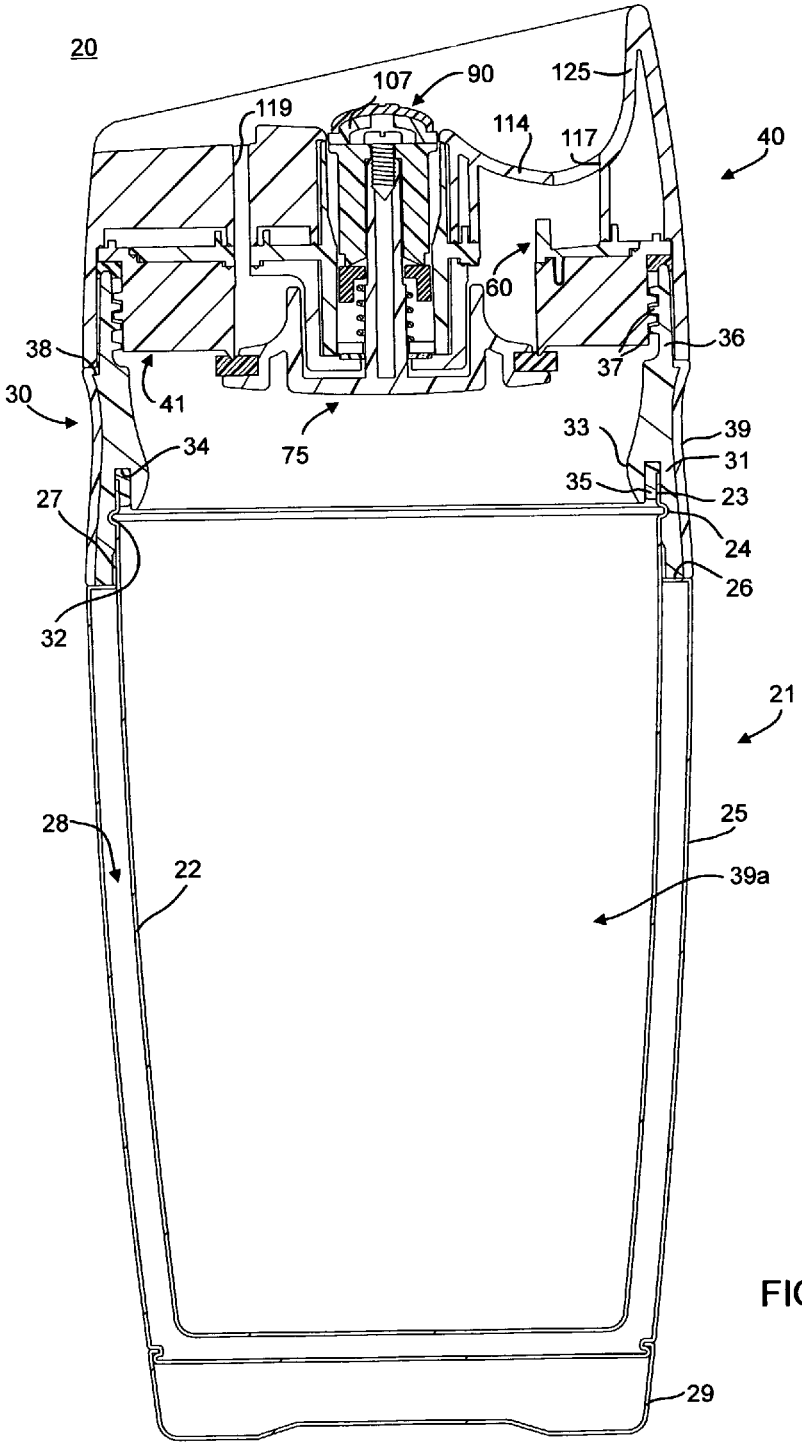
FIG. 5 is an enlarged sectional view taken generally along lines 5—5 in FIG. 1.

The base 21 is provided at its upper end with a neck portion 30 including a generally cylindrical wall 31, which may be formed of a suitable plastic material and is provided along its inner surface with a circumferential groove 32 (FIG. 5) for receiving therein, in snap-fitted engagement, the circumferential rib 24 of the base inner wall 22. The wall 31 is also provided with an inner annular flange 33 which cooperates with the wall 31 to define therebetween an annular slot 34, which receives the upper edge of the inner wall 22 and an annular gasket 35. Projecting upwardly from the upper end of the wall 31 is a cylindrical lip 36, provided with an internal thread 37. An annular shoulder 38 is formed in the outer surface of the wall 31 at the base of the lip 36. A grip sheath 39 formed of a suitable elastomeric material may be over molded on the outer surface of the wall 31 and along the shoulder 38 so that, in assembly, its outer surface is substantially flush with the outer surface of the base outer wall 25. It can be seen that the base 21 defines therein a beverage containing reservoir 39*a* (FIG. 5).

The beverage container 20 also includes a removable cover assembly 40 made up of a bottom 41, a top 60, a valve assembly 75, an actuator assembly 90 and a cap 110. Referring to FIGS. 4, 6, 9 and 10, the bottom 41 may be of unitary, one-piece, molded plastic construction, and includes an outer cylindrical sidewall 42 provided with an external thread 43, an intermediate cylindrical wall 44 joined to the outer cylindrical sidewall 42 by an annular bottom wall 45 and by a plurality of equiangularly spaced-apart radial webs 46, and an inner cylindrical wall 47 joined to the intermediate cylindrical wall 44 by an annular top wall 48. The inner cylindrical wall 47 is closed at its lower end by a bottom wall 49 having a circular central aperture 50 formed therethrough, the upper or inner end of which is surrounded by an annular recess 51. The lower end of the intermediate cylindrical wall 44 defines a valve seat 52 in the form of a rigid circular edge, as will be explained more fully below. The intermediate and inner cylindrical walls 44 and 47 and the top wall 48 cooperate to define an open-bottom annular chamber 53. A vent hole 54 is formed in the top wall 48 adjacent to the intermediate cylindrical wall 44 and communicates with the chamber 53. Also, communicating with the chamber 53 is a generally semicircular-shaped discharge opening 55 formed in the top wall 48 substantially diametrically opposite the vent hole 54. Integral with the outer cylindrical sidewall 42 at its upper end and extending laterally outwardly therefrom is an annular flange 56 provided with an upstanding annular rib 57 spaced radially inwardly a slight distance from the outer edge of the flange 56 for cooperation therewith to define an annular shoulder 58. A notch 59 is formed in the upper end of one of the webs 46 adjacent to the discharge opening 55.

Referring to FIGS. 4, 6 and 11–14, the top 60 may be of unitary, one-piece, molded plastic construction and includes a substantially circular base wall 61. Depending from the base wall 61 adjacent to its outer edge at two diametrically opposed locations are two pairs of wall structures 62, each of which is generally trapezoidal in shape and has an open bottom, the wall structures 62 being respectively receivable, in assembly, in corresponding compartments defined in the bottom 41 between the intermediate and outer sidewalls 44 and 42 and between adjacent radial webs 46. A central, generally circular opening 63 is formed through the base wall 61 and is encircled by a depending cylindrical hub 64 having four equiangularly spaced-apart grooves 65 formed in the inner surface thereof and communicating with the opening 63 and terminating at a shoulder 65*a* intermediate the ends of the hub 64. Surrounding the upper end of the opening 63 and upstanding from the base wall 61 is an oval-shaped turret 66. A vent opening 67 is formed through the base wall 61, radially approximately midway between the opening 63 and the outer edge of the base wall 61, and is surrounded by an upstanding peripheral cylindrical wall 68. Depending from the base wall 61 at a location diametrically opposite the vent opening 67 is a generally rectangular tab 69. A generally semicircular-shaped discharge opening 70 is formed through the base wall 61 between the tab 69 and the central opening 63. A generally rectangular baffle wall 71 is upstanding from the base wall 61 along the radially outer edge of the discharge opening 70. An oblong upstanding peripheral wall 72 encircles the discharge opening 70, the baffle wall 71 and adjacent portions of the upper surface of the base wall 61. The outer edge of the base wall 61 is under cut along its underside to define an annular shoulder 73.

Figure 4:
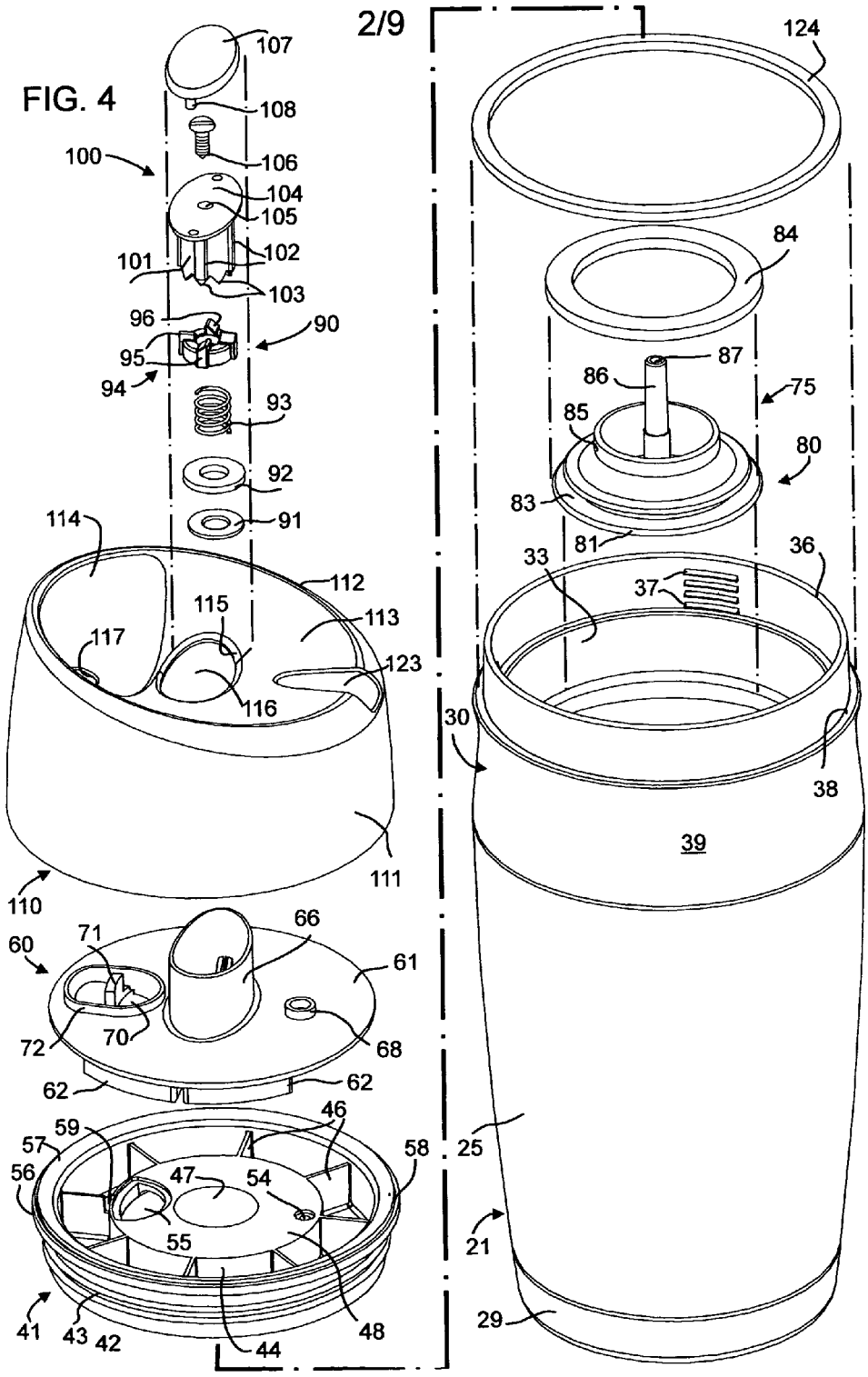
FIG. 4 is an enlarged, exploded, perspective view of the beverage container of FIG. 1.
Figure 6:
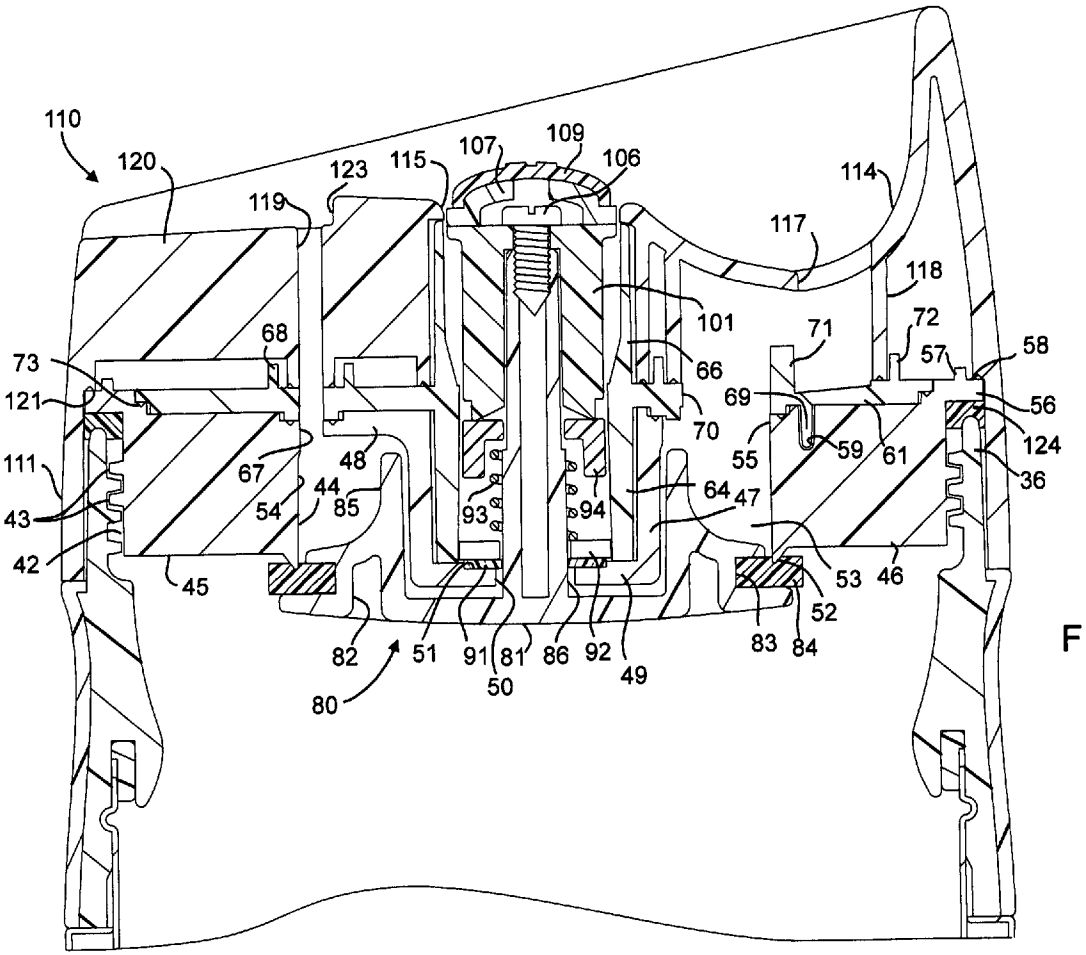
FIG. 6 is a further enlarged, fragmentary view of the upper portion of FIG. 5.

Referring in particular to FIGS. 4 and 6, the valve assembly 75 includes the valve seat 52 of the bottom 41, described above, and a movable valve member 80. The valve member 80 may be of unitary, one-piece, molded plastic construction and includes a circular base 81 having an annular groove 82 formed in the bottom thereof and having an annular peripheral groove 83 formed in the sidewall thereof. An elastomeric gasket 84 is received in the groove 83 and projects laterally outwardly a slight distance therebeyond. Preferably, the base 81 along the upper side of the groove 83 has a diameter slight less than the portion thereof along the bottom of the groove 83 to provide clearance for the gasket 84 to engage the valve seat 52, as can best be seen in FIG. 6 and as will be explained more fully below. Upstanding from the base 81 is a generally cylindrical wall 85 and a central hollow cylindrical post 86 which projects upwardly well beyond the upper edge of the wall 85 and is provided with a distal end opening 87.

In assembly, after the bottom 41 and the top 60 have been assembled together, the post 86 of the valve member 80 is fitted upwardly through the central aperture 50 in the bottom 41 and the central opening 63 of the top 60, with the cylindrical wall 85 being received in the annular chamber 53, as can best be seen in FIG. 6.

The valve member 80 is disposed for operation by an actuator assembly 90, which includes a gasket 91 seated in the annular recess 51 of the bottom 41 for fluid-tight sealing engagement with the outer surface of the valve member post 86. An annular plastic seat 92 is disposed on the gasket 91 for seating the lower end of a helical compression spring 93, which encircles the post 86. Engaged with the upper end of the spring 93 is a spinner 94, which may be of one-piece, molded plastic construction. The spinner 94 has four equiangularly spaced-apart, laterally outwardly projecting arms 95, respectively disposable in the grooves 65 of the top 60, each arm 95 being provided at its upper end with an angled cam follower surface 96. The actuator assembly 90 also includes a pusher 100, which may be of molded, one-piece plastic construction, and includes a generally cylindrical hub 101 provided with a plurality of equiangularly spaced-apart, and longitudinally extending external ribs 102, which are respectively disposable in the grooves 65 of the top 60. The hub 101 is provided at its lower end with eight circumferentially spaced, inclined cam surfaces 103, alternate ones of which are disposed for camming engagement with the cam following surfaces 96 of the spinner 94. The hub 101 is integral at its upper with a laterally outwardly projecting oval flange 104 having a central aperture 105 formed therein. The hub 101 is hollow and fits down over the upper end of the valve member post 86, being secured thereto by a screw 106 which extends through the aperture 105 and threadedly engages in the opening 87 of the post 86. An oval button 107 overlies the flange 104 and has stakes 108 which may be pressed fitted in openings in the flange 104 for securing the button 107 in place, the flange 104 being shaped and dimensioned to be matably received in the oval turret 66 of the top 60. The button 107 may be provided with an elastomeric overmold 109.

The actuator assembly 90 is a known type of toggle mechanism which latches the valve member 80 alternately in open and closed conditions with alternate depressions of the pusher 100. Referring to FIG. 6, if the valve assembly 75 is assumed to be in normal closed condition, as illustrated, with the gasket 84 in sealing engagement with the valve seat 52, the button 107 will project a slight distance upwardly above the upper end of the oval turret 66, the valve assembly 75 being resiliently held in this closed condition by the spring 93. When the button 107 is depressed, the pusher 100 and the valve member 80 both move downwardly, pushing the spinner 94 downwardly until it clears the lower ends of the grooves 65 in the top hub 64, whereupon the camming engagement of the cam surfaces 103 with the cam follower surfaces 96 rotates the spinner 94 45°, bringing its arms 95 out of alignment with the grooves 65, so that when the button 107 is released, the spring 93 cannot return the spinner 94 to its original position and it is stopped against shoulder 65*a* in the hub 64, thereby holding the valve member 80 in an open condition, with the gasket 84 spaced from the valve seat 52 to allow the flow of beverage therebetween into the annular chamber 53. The next time the pusher 100 is depressed the spinner is rotated another 45°, bringing its arms 95 back into alignment with the grooves 65 so that, when the button 107 is released, the spinner can return to its original position, allowing the valve to close.

Figure 7:
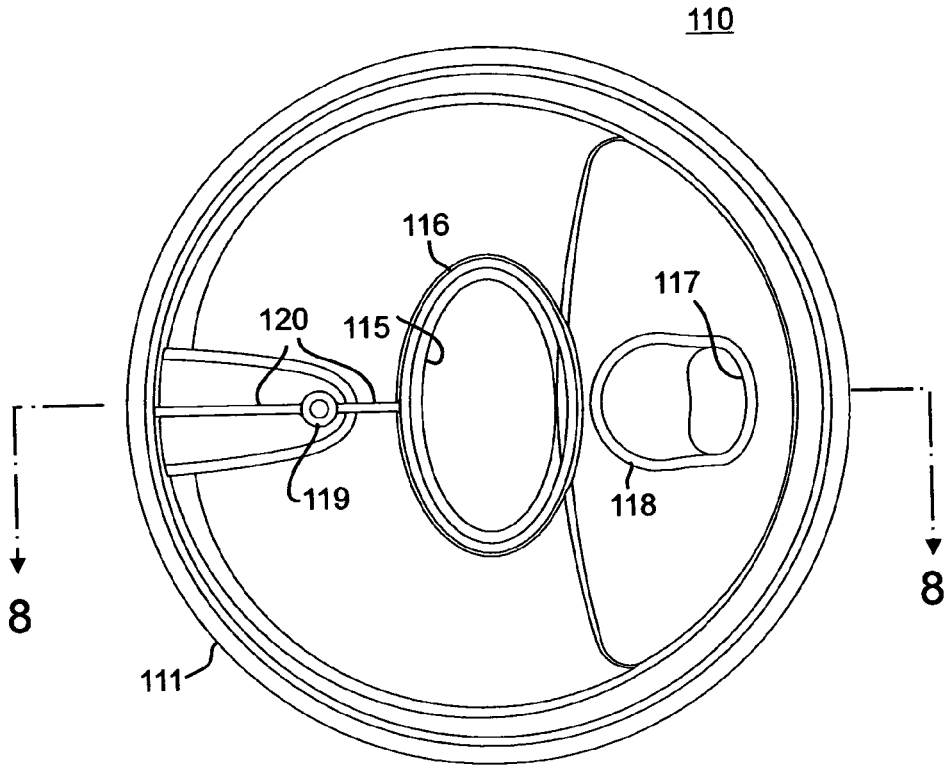
FIG. 7 is an enlarged bottom plan view of the cap of the container of FIG. 4.
Figure 8:
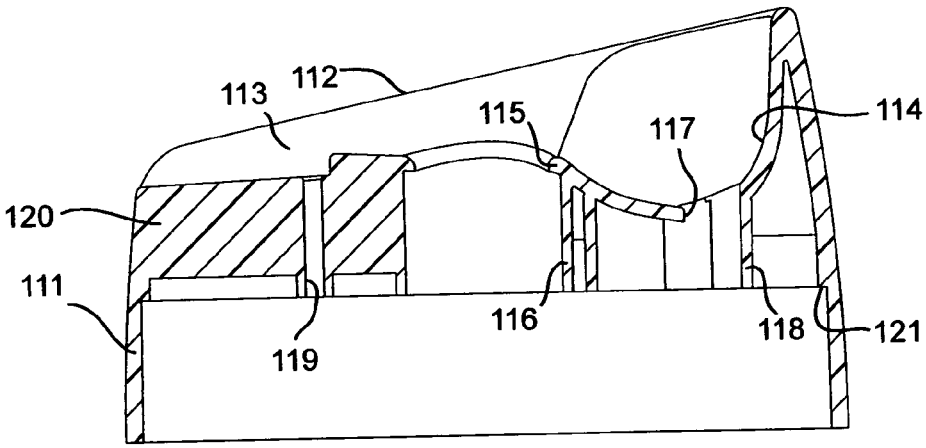
FIG. 8 is a sectional view taken generally along the line 8—8 in FIG. 7.
Figure 9:
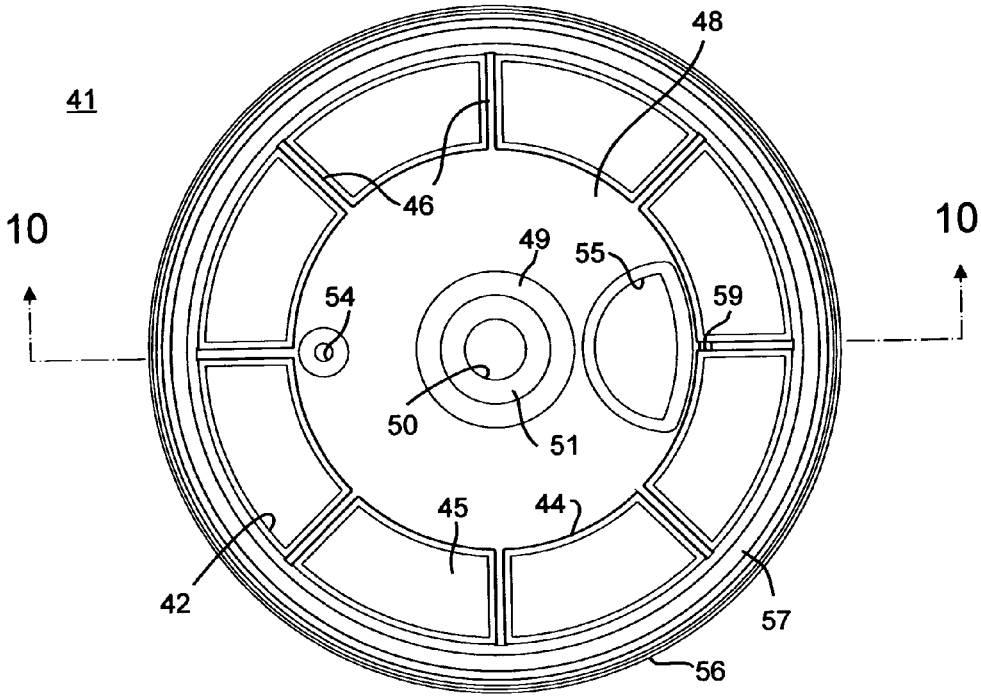
FIG. 9 is an enlarged bottom plan view of the cover assembly base of the container of FIG. 4.
Figure 10:
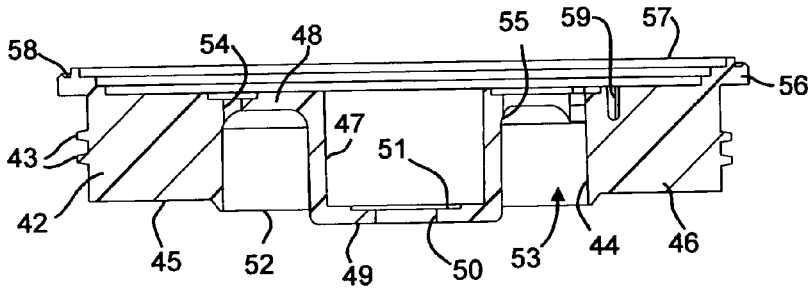
FIG. 10 is a sectional view taken generally along the line 10—10 in FIG. 9.
Figure 11:
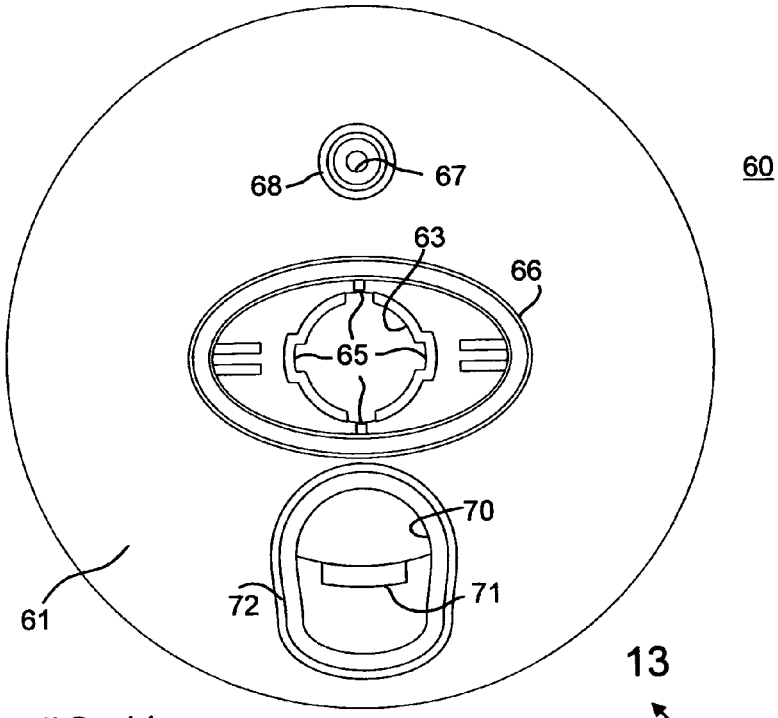
FIG. 11 is an enlarged, top plan view of the cover assembly top of the container of FIG. 4.
Figure 12:
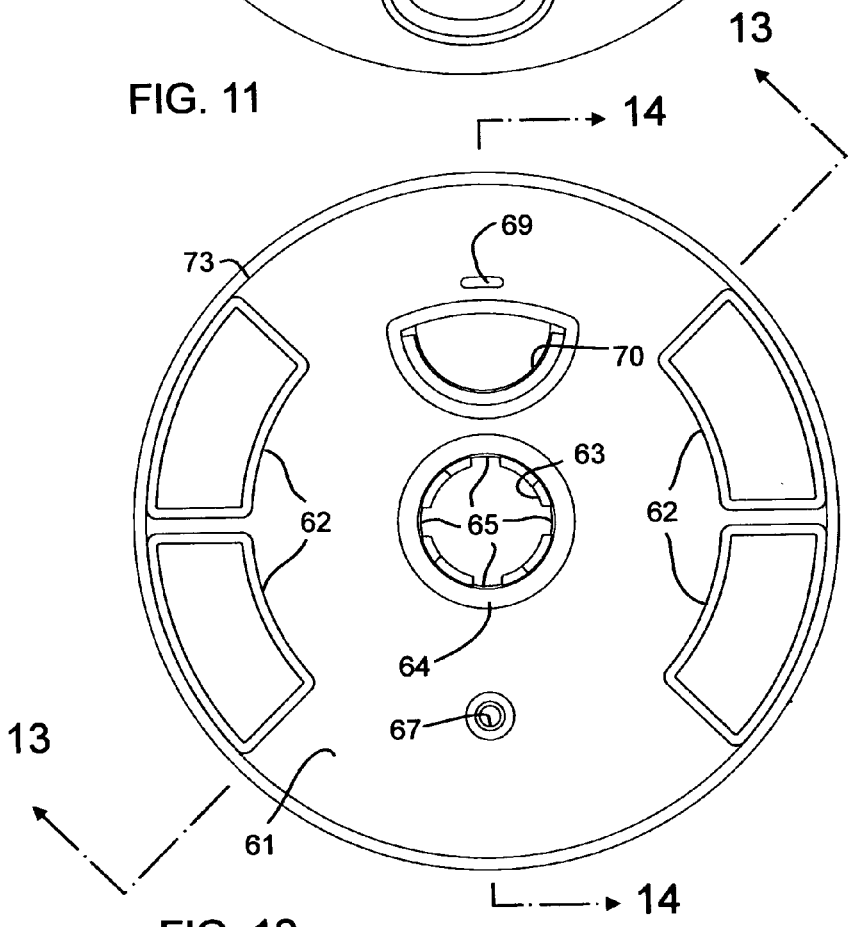
FIG. 12 is a bottom plan view of the cover assembly top of FIG. 11.
Figure 13:
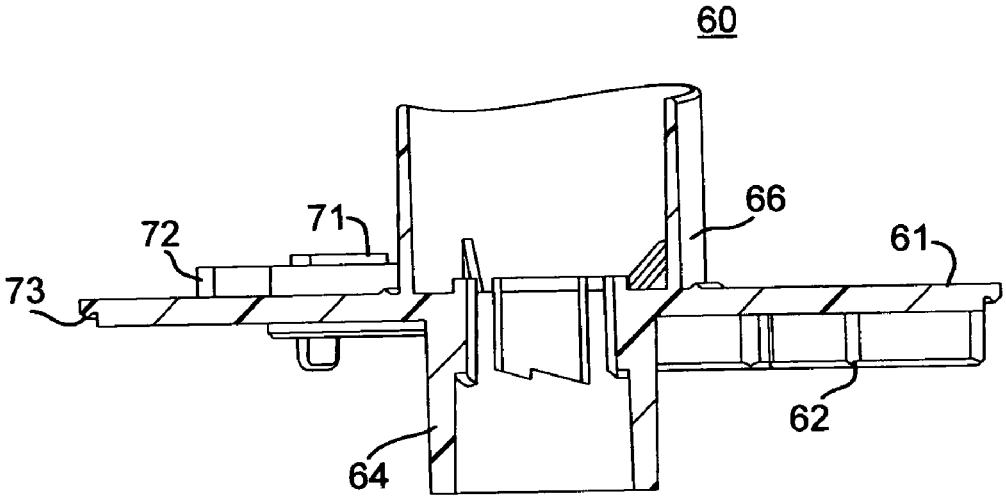
FIG. 13 is a sectional view taken generally along the line 13—13 in FIG. 12.
Figure 14:
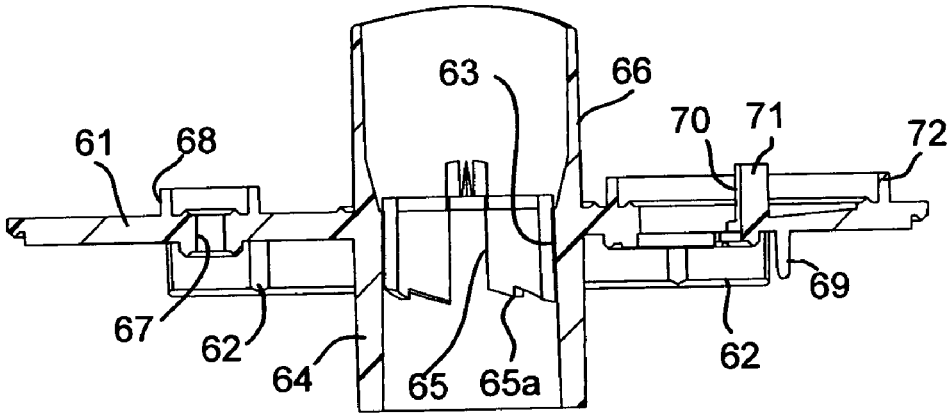
FIG. 14 is a sectional view taken generally along the line 14—14 in FIG. 12.

Referring also to FIGS. 7 and 8, the cover assembly 40 includes a cap 110, which may be of one-piece, molded plastic construction and has a generally cylindrical peripheral sidewall 111 having a sloping upper edge 112 and being closed at its upper end by a concave upper wall 113 having a deep recess 114 formed therein at one side thereof and open to ambient. Formed through the upper wall 113 centrally thereof is a large oval aperture 115 bounded by a depending oval skirt wall 116 dimensioned to receive therein the oval turret 66 of the top 60. Formed through the top wall 113 at the lowermost point of the deep recess 114 is a generally kidney-shaped drain/drink opening 117 bounded by a depending skirt wall 118 dimensioned to fit matably inside the peripheral wall 72 of the top 60. Also formed through the upper wall 113 on the side thereof diametrically opposite the drain/drink opening 117 is a vent opening 119 defined by depending vent tube joined to the skirt wall 116 and to the peripheral wall 111 by a radially extending stiffening web 120. The peripheral sidewall 111 has a reduced-thickness lower end for forming an annular shoulder 121 on the inner surface thereof (FIG. 8). The vent opening 119 is surrounded by a vent channel 123 which is formed in the upper surface of the upper wall 113 and extends from vent opening 119 to the adjacent side edge of the cap 110.

In assembly, the base inner wall 22 and outer wall 25 are welded together at the flange 27 and a vacuum is pulled from the space therebetween at the bottom and closed off with the base pedestal 29. The plastic, internally threaded neck portion 30 with the gasket 35 is then snapped over the circumferential rib 24 of the base 21, after being overmolded with the sheath 39 to provide a good grip.

In assembling the cover assembly 40, the top 60 is fitted over the bottom 41, with the discharge opening 70 substantially aligned with the discharge opening 55, and with the vent opening 67 aligned with the vent hole 54, and with the wall structures 62 respectively received in adjacent ones of the cavities formed between adjacent radial webs 46. As can best be seen in FIG. 6, the shoulder 73 of the top 60 is seated on a complementary shoulder on the bottom 41, the cylindrical hub 64 is received coaxially within the inner cylindrical wall 47 of the bottom 41 in engagement with the bottom wall 49, the tab 69 is received in the notch 59, and the parts are then ultrasonically welded together. Then the cap 110 is fitted over the top 60, with the oval turret 66 of the top 60 fitted up inside the skirt wall 116 of the cap 110, and with the lower ends of the vent tube 119 and the skirt wall 118 respectively fitted inside the vent opening peripheral wall 68 and the discharge opening peripheral wall 72 of the top 60, with the shoulder 58 of the bottom 41 seated against the shoulder 121 of the cap 110, and with the bottom rib 57 fitted up along the inner surface of the cap peripheral wall 111 above the shoulder 121. Then the cap 110 is ultrasonically welded to the bottom 41 and the top 60. An elastomeric gasket 124 is then fitted over the outer cylindrical side wall 42 of the bottom 41 and seated against the flange 56 (see FIGS. 4 and 6).

Next, the valve member 80, with its gasket 84, is inserted into the bottom 41 from the bottom thereof, as was explained above, with the post 86 extending up through the aligned openings 50 and 63 of the bottom and top, respectively. The wiper gasket 91, spring seat 92, spring 93, spinner 94 and pusher 100 are then inserted into the top oval turret 66 through the cap aperture 115 in the order mentioned, with the spinner arms 95 and the pusher ribs 102 respectively disposed in the grooves 65 of the top cylindrical hub 64. The pusher 100 is then screwed to the valve member post 86 using the screw 106, as explained above. The button 107 with its overmold 109 is then press fitted onto the oval flange 104 of the pusher 100, as explained above, to complete the assembly.

In operation, after filling the reservoir 39*a* with beverage, the cover assembly 40 is mounted on the base 21, the bottom 41 of the cover assembly 40 being threadedly engaged with the lip 36 of the base 21 until the gasket 124 sealingly engages the upper end of the lip 36, the gasket 124 yieldably deforming over the upper end of the lip 36 to provide a good fluid-tight seal. Then, the valve assembly 75 can be toggled between open and closed conditions utilizing the actuator assembly 90, in the manner described above. When the valve member 80 is in its closed condition, illustrated in FIG. 6, the gasket 84 deforms around the sharp edge of the valve seat 52 to provide a good fluid-tight seal.

When the valve assembly 75 is open, beverage in the reservoir 39*a* may flow into the annular chamber 53 in the bottom 41 between the valve member 80 and the valve seat 52 when the beverage container 20 is tilted, in a known manner. In this regard, it will be appreciated that the annular chamber 53, which forms a generally horizontally disposed chamber, cooperates with the discharge openings 55 and 70 and the skirt wall 118 and the drain/drink opening 117 to form a drain/drink or discharge passage through the cover assembly 40 from the reservoir 39*a* to the drain/drink opening 117. The aligned discharge openings 55 and 70, the depending skirt wall 118 of the cap 110 and the drain/drink opening 117 cooperate to form an upright chamber of the discharge passage with inlet (opening 70) and outlet (opening 117) laterally offset from each other and separated by the baffle wall 71. It will also be appreciated that the aligned vent hole 54 and vent openings 67 and 119 provide communication between the reservoir 39*a* and ambient when the valve assembly 75 is open, to facilitate discharge of beverage through the discharge passage. Because of the convoluted discharge passage going from generally horizontal to upright chambers, the latter having laterally offset inlet and outlet and being provided with a baffle wall 71, the rapid discharge of beverage is inhibited so as to minimize the chance of spillage in use. The sloping upper edge 112 of the cap 110 cooperates with the deep recess 114 to form a raised lip 125 (see FIG. 5) which can be received in the user's mouth to facilitate flow of beverage through the drain/drink opening 117 into the user's mouth, while minimizing risk of spillage. It will be noted that the button 107 of the actuator assembly 90 is spaced from the deep recess 114 so that it does not come in contact with discharged beverage in use. Also, it will be noted that the vent channel 123 of the cap 110 tends to drain away from the button 107 any beverage which might accidentally be discharged through the vent opening 119 when the valve assembly 75 is open.

Figure 15:
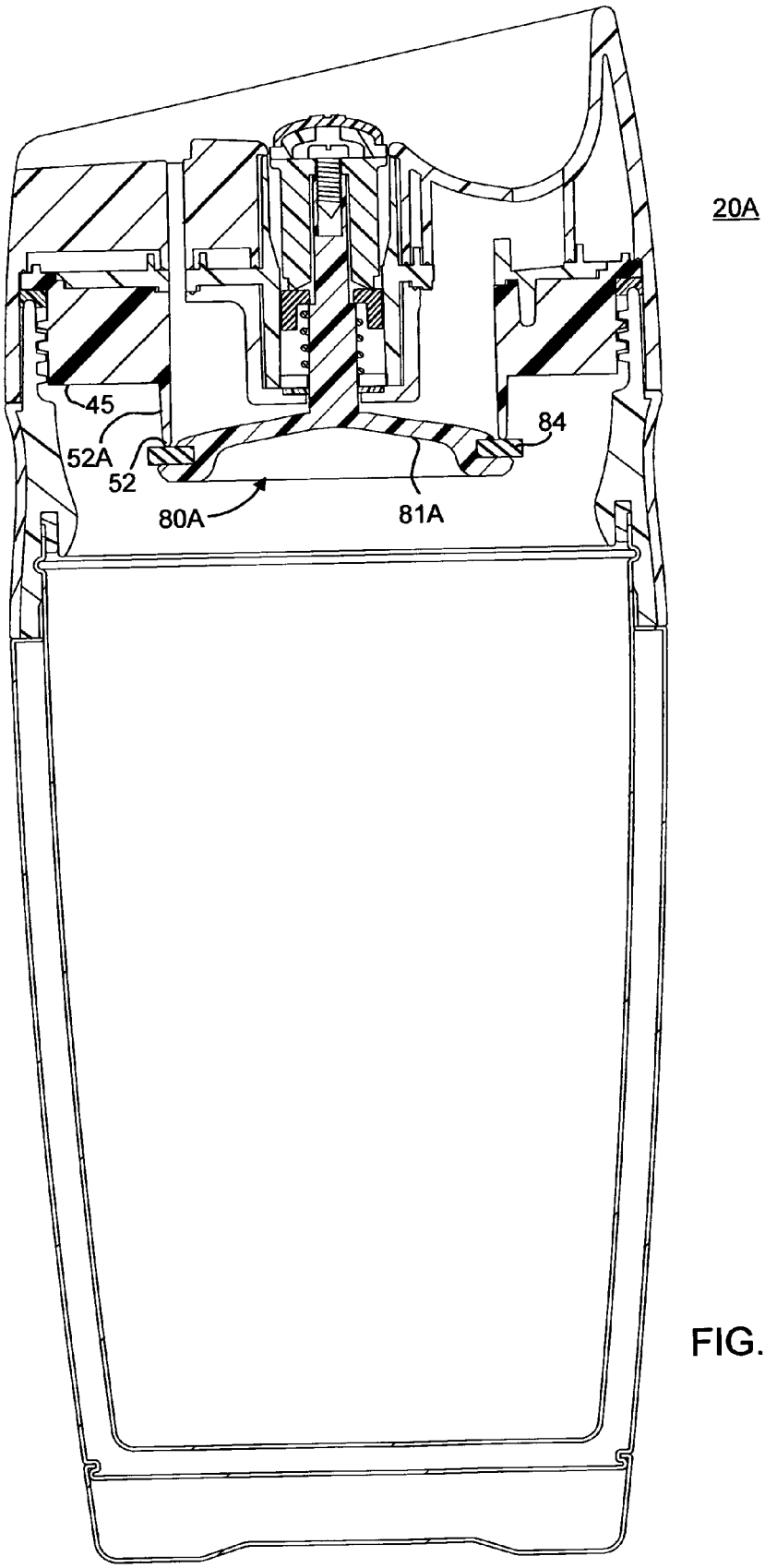
FIG. 15 is a view similar to FIG. 5 of another embodiment.

Referring to FIG. 15, there is illustrated an alternative embodiment of beverage container, generally designated by the numeral 20A, which is substantially identical to the beverage container 20 described above, with the following exceptions. The beverage container 20A has a valve member 80A having a base 81A which slopes downwardly and laterally outwardly from a central region, and in which the cylindrical wall 85 (FIG. 6) has been removed. This prevents collection of liquid on the valve member base and permits easy drainage therefrom. Because of the resulting lowered position of the gasket 84, the rigid edge 52 forming the valve seat has been formed at the bottom of a cylindrical flange 52A depending from the annular bottom wall 45.

From the foregoing, it can be seen that there has been provided an improved travel beverage container which includes an effective fluid-tight valve assembly which is push button-actuated, wherein the actuator mechanism is isolated from contact with discharged beverage, and providing a discharge passage which inhibits unduly rapid discharge of beverage in use.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A beverage container comprising:

a base having inner and outer walls cooperating to define a thermally insulating vacuum space therebetween and defining a beverage-containing reservoir, a cover assembly removably mountable on the base for closing the reservoir, the cover assembly comprising:

a cap positioned at an upper and outer surface of the cover assembly and defining a recess also on the upper and outer surface and open to ambient when the cover assembly is mounted on the base, the cap having an aperture therethrough spaced from the recess, a drain/drink passage opening to and communicating with the recess, a vent opening providing communication between the drain/drink passage and ambient, the vent opening having an exit end exiting the cap at a location spaced from the aperture and from the recess, and a valve assembly movable between an open condition providing communication between the reservoir and the drain/drink passage and a closed condition sealing the drain/drink passage from the reservoir, and a manually operated actuator mechanism accessible through the aperture of the cap.

2. The container of claim 1, wherein the actuator mechanism includes a push button.

3. The container of claim 2, wherein the push button is disposed centrally of the cap.

4. The container of claim 3, wherein the passage communicates with the recess at a location spaced radially outwardly from the push button.

5. The container of claim 1, wherein the valve assembly is disposed centrally of the cover assembly.

6. The container of claim 1, wherein the actuator mechanism includes a toggle mechanism so that alternate actuations of the actuator mechanism respectively latch the valve assembly in its open and closed conditions.

7. The container of claim 1, wherein the cap has a vent channel communicating with the exit end of the vent opening and configured to channel liquid exiting the vent opening away from the recess and the aperture.

8. The container of claim 1, wherein the cap includes a raised lip extending from the recess to facilitate directing of beverage from the recess to a user's mouth.

* * * * *